US006398035B1

(12) United States Patent
Vojtisek

(10) Patent No.: US 6,398,035 B1
(45) Date of Patent: Jun. 4, 2002

(54) MAXIMIZER FOR GRAVITY SEPARATORS

(75) Inventor: Erich Vojtisek, Stockerau (AT)

(73) Assignee: Cimbria Heid GmbH (AT)

( * ) Notice: Subject to any disclaimer, the term of this patent is extended or adjusted under 35 U.S.C. 154(b) by 0 days.

(21) Appl. No.: 09/551,185

(22) Filed: Apr. 17, 2000

(51) Int. Cl.[7] ..... B07B 4/08

(52) U.S. Cl. ..... 209/132; 209/137; 209/138; 209/139.1; 209/142; 209/143; 209/466; 209/467; 209/486; 209/502

(58) Field of Search ..... 209/132, 137, 209/138, 139.1, 142, 143, 466, 486, 467, 502

(56) References Cited

U.S. PATENT DOCUMENTS 3,777,887 A * 12/1973 Johnston et al. ..... 209/474
4,865,722 A * 9/1989 Ririe et al. ..... 209/474
5,048,693 A * 9/1991 Zaltman ..... 209/137

* cited by examiner

*Primary Examiner*—Donald P. Walsh
*Assistant Examiner*—Jonathan R Miller
(74) *Attorney, Agent, or Firm*—Zarley, McKee, Thomte, Voorhees & Sease, P.L.C.

(57) ABSTRACT

A gravity separator with improved efficiency comprising a gravity table with pins at the feed area and a flow channeler. The pins create space in the bed of material to be separated which increases stratification of the weight fractions. The flow channeler creates flow paths of the fractions which do not cross and therefore the fractions do not slow each other from feed to discharge.

13 Claims, 4 Drawing Sheets

MAXIMIZER FOR GRAVITY SEPARATORS

BACKGROUND OF THE INVENTION

Gravity separators are used in various industries. Gravity tables are generally used for separating dry particles of similar, or identical, size and shape, but which vary in specific gravity and/or weight. For example, in the seed industry, low germination seed generally is lower density than seed with desired germination characteristics. Thus, the light seed is separated and discarded while the heavy seed goes on to be used. A middlings fraction (weight in between the light and heavy seed) is usually rerun for better separation and then discarded.

The grains or particles of product are fed continuously onto the separating deck surface of a gravity separator providing a bed of material over the surface. The bed is fluidized by a uniform pressurized air system, thereby stratifying the light material to the top of the product bed and allowing the heavy material to contact the deck surface. The deck is inclined from side to side and from inlet end to discharge end at adjustable angles. The deck is moved at low amplitude and high frequency up hill. The heavy material contacting the wire mesh deck surface moves up, while the light material fluidized by the air system moves down due to gravity. Flaps, or discharge gates, direct the weight fractions off the appropriate edge of the table.

Conventional wisdom in gravity tables is to utilize the movement of the deck and air pressure to start moving light product up while allowing they heavy product to contact the deck and begin its movement to the high side of the table. Because the depth of the product in the feed zone is much deeper due to the smaller area of the deck and there is an initial lack of movement of the product, it is difficult to effectively stratify the product in this crowded area. This crowding significantly reduces the throughput capacity of the machine and can reduce the separating efficiency. Attempts at better distribution of product have been made using various levels of airflow, pitch and slope, screen designs deck configurations, and the like, however, these design changes have only resulted in minimal increases in separation efficiency. Therefore, there is a need for an improved gravity table which achieves increased efficiency.

SUMMARY OF THE INVENTION

An object of the invention is to provide gravity separators with more efficient separation.

Another object of the invention is to provide a method for improving efficiency of gravity separation.

These and other objects, features, and advantages will become apparent after review of the following description and claims of the invention which follow.

The present invention greatly improves the separation efficiency of gravity tables. The invention has "pins" in the inlet area of the gravity table deck. The pins "split" the separation force into two directions and creates space within the product bed making movement within the bed easier. Additionally, the invention has a change of the shape of the light rail wall of the deck. The deck shape has been reconfigured by bringing the light rail side wall of the deck toward the middle of the table changing the flow pattern of the product fractions across the deck.

DETAILED DESCRIPTION OF THE PREFERRED EMBODIMENT

Figure 1:
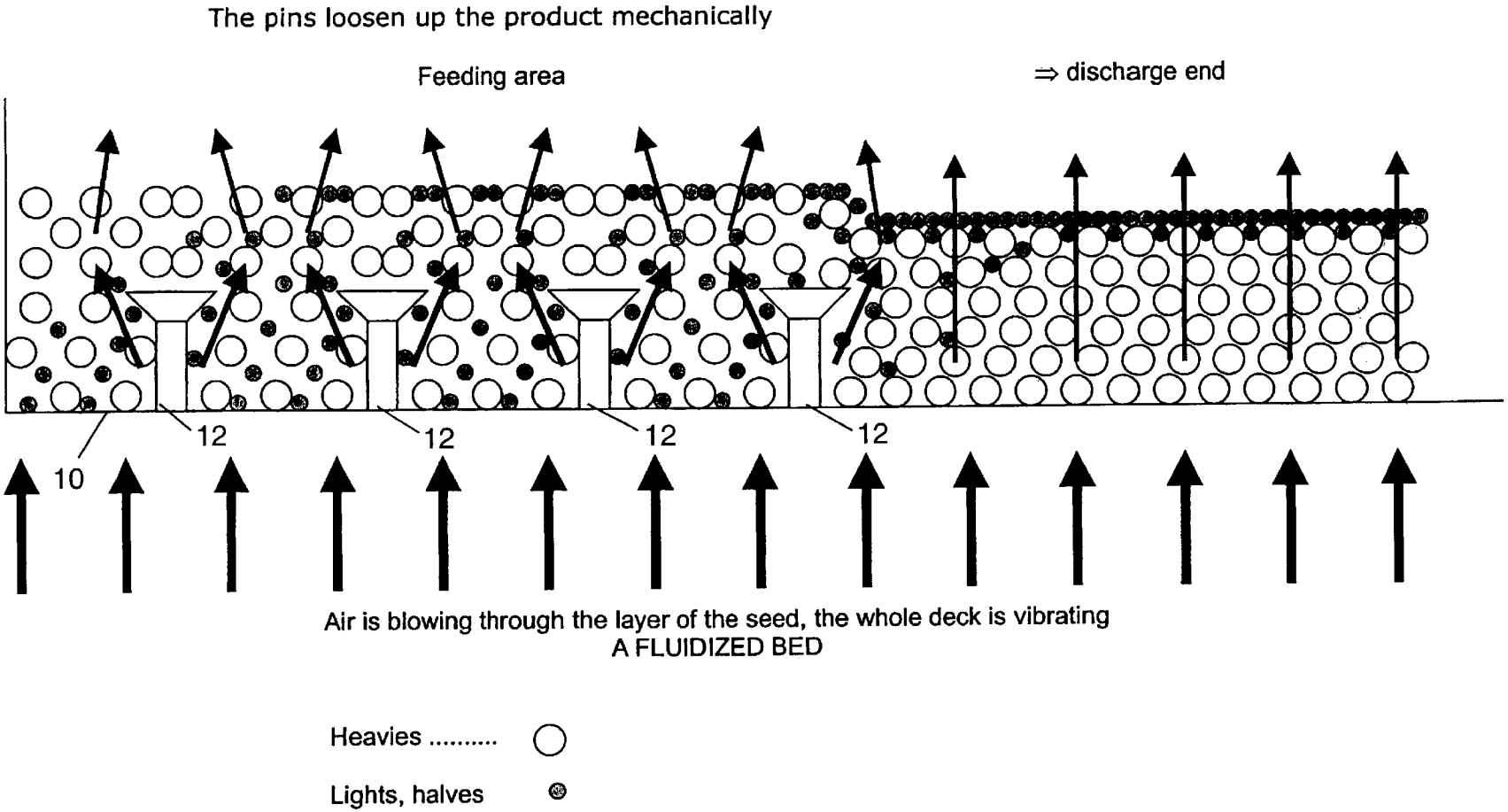
FIG. 1 is a schematic of fluidization of the bed with the added pins.

The Figures show the preferred embodiment of the present invention. A gravity table 10 is equipped with "pins" 12 in a pattern such that vertical space is created in the bed of product at the feed area 14 end of the table 10. The table 10 also has a "flow channeler" 16, or protruding wall, which changes the flow patterns of the product fractions on the table. The heavies discharge edge 18 and the light discharge end 20 are equipped with flaps 22, or gates.

In the prior art in the inlet area of the deck, the loosening up, and therefore, distribution over the deck, of the product was only made by the air flow from the blower from underneath. Vibration of the deck together with this air flow was able to achieve the separation. However, heavy particles are only able to move toward the heavy discharge edge of a gravity table if they are touching the deck. This prior art separation was essentially one dimensional. The use of higher air flow was able to effect a greater distribution of the product over the inlet area, but stratification of the layers (weight fractions) was not possible due to remixing of the product by the air. Less air prevented remixing and some stratification could begin at the inlet area, but the inlet became crowded with product, thereby limiting the throughput capacity.

The present invention has "pins" 12, or protrusions, in the inlet area of the gravity table deck. These pins are connected to, or are part of, the deck and vibrate together with the deck. This splits the separation force into two directions. The airflow (pneumatic force) is able to separate the product vertically to the deck, and the mechanical vibration of the pins on the deck creates a force parallel to the deck. Pins create free space between the product particles making it easier for the product sizes to move vertically (stratify), and thus, the present invention requires less air flow. The stratification is accelerated as the product is added to the deck. The stratification tends to move with the deck, creating small openings so that the light product trapped under the bed of material can move up, thus allowing heavier material to move down and contact the deck. This action significantly increases capacity by moving heavier product up and off the high side of the deck sooner and allowing more time (i.e., deck space) down the machine for the middlings (i.e., not the heaviest and not the lightest material) to efficiently separate. This ultimately reduces the size of both the light and middling fractions while maintaining a high throughput. Since this can be done with less air, this significantly reduces the remixing and improves capacity per square foot of deck area and overall separation efficiency.

Figure 3:
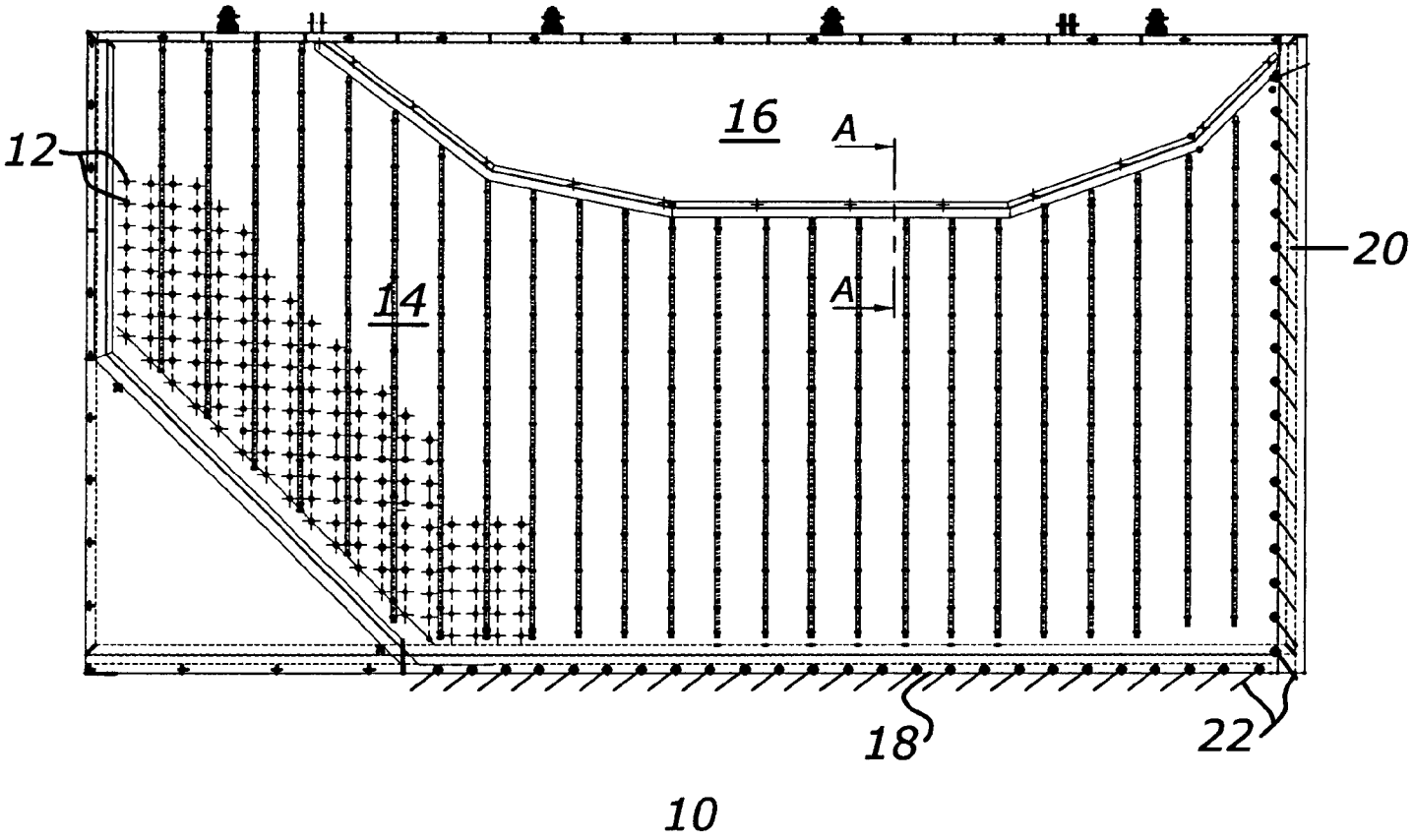
FIG. 3 shows the top view of the table.
Figure 4:
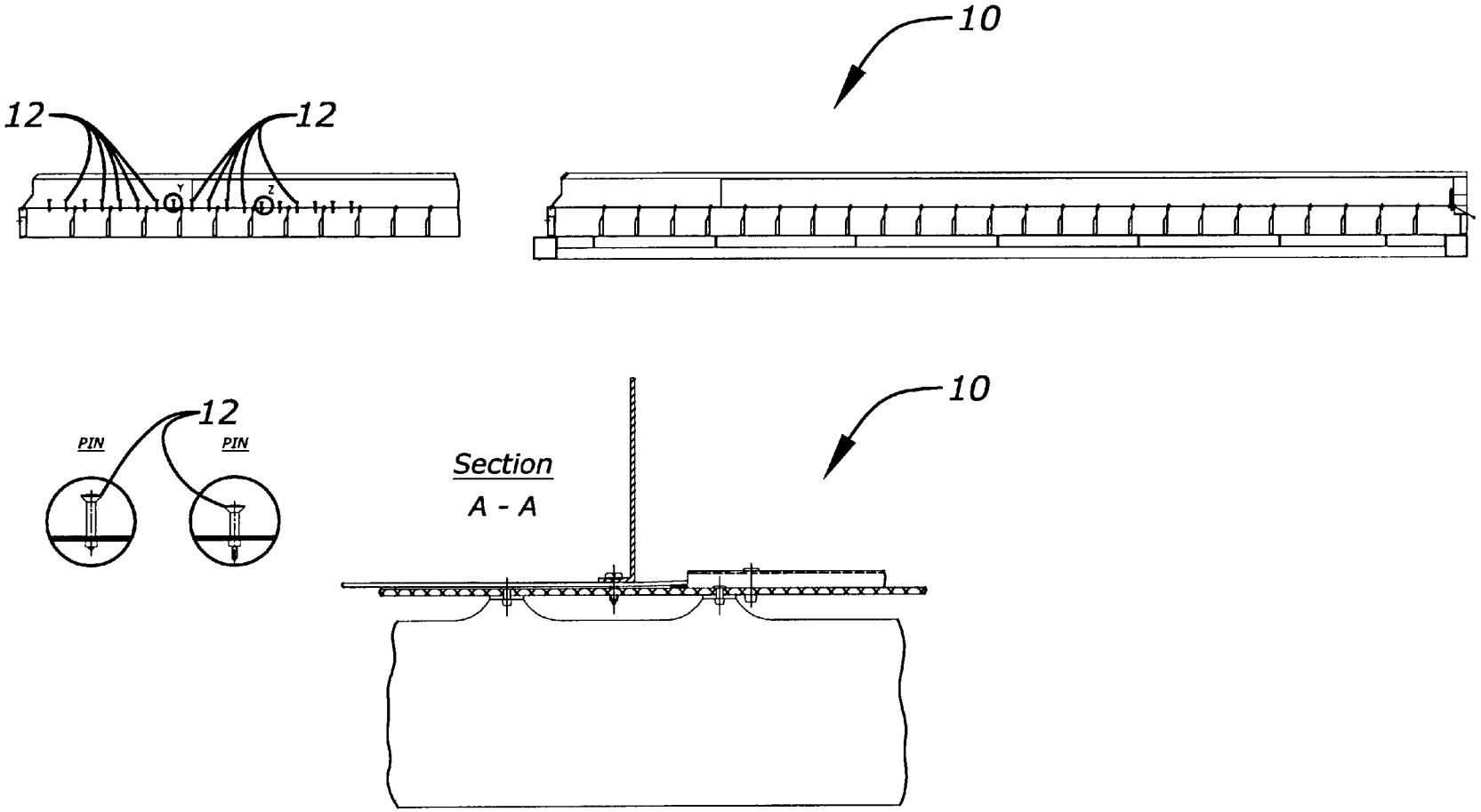
FIG. 4 shows a cross-section of the table and pins.

In the preferred embodiment, the pins comprise a cylindrical support with a truncated conical top (see FIGS. 1, 4). The conical top changes the direction of the airflow, so no channeling of the air inside the layer of product near the pins is possible. At nominal capacity, the distance between the top of the conical portion and the top of the layer of product is approximately one-quarter of the entire thickness of the product layer. The material of which the pins are made is non-critical and need only be resistant to the abrasion of the product and the mechanical stress due to the vibrations. The pins are preferably located so as to optimize "loosening up" of the incoming product. The pins are primarily mounted in the upper half of the inlet, or feed, area. This portion of the feeding area is where the most heavies are located after separating. The total number of pins depends on the size of the deck. The distance between the pins depends where they can be attached, i.e., in the preferred embodiment, the distance between the "bars" of the wire mesh of the deck. In the preferred embodiment, there are always two rows of pins between two bars. The area of pins preferably ends at the heavy discharge side with the first flap. The pins have been constructed using screws and rivets. Mild steel, hardened steel and plastic were tested as materials for the pins. Though mild steel was chosen as the preferred material, alternatives can include, but are not limited to, stainless steel and galvanized steel, depending on the material of the wire-mesh of the deck. Placement that has been used is indicated on FIGS. 3 and 4. One of skill in the art would be able to determine the size, shape, material, placement and spacing of the pins for a particular application.

In the prior art, the product coming from the feed area is distributed over the entire deck. With poor pre-stratification at the feed area, the lights and heavies must travel further to reach their respective discharge areas. The heavies must not only travel up through the lights which reduces their speed, but there is also remixing due to crossing of the flow paths of the weight fractions in the zone of the middlings, this increases, or extends, the zone of the middlings.

Figure 2:
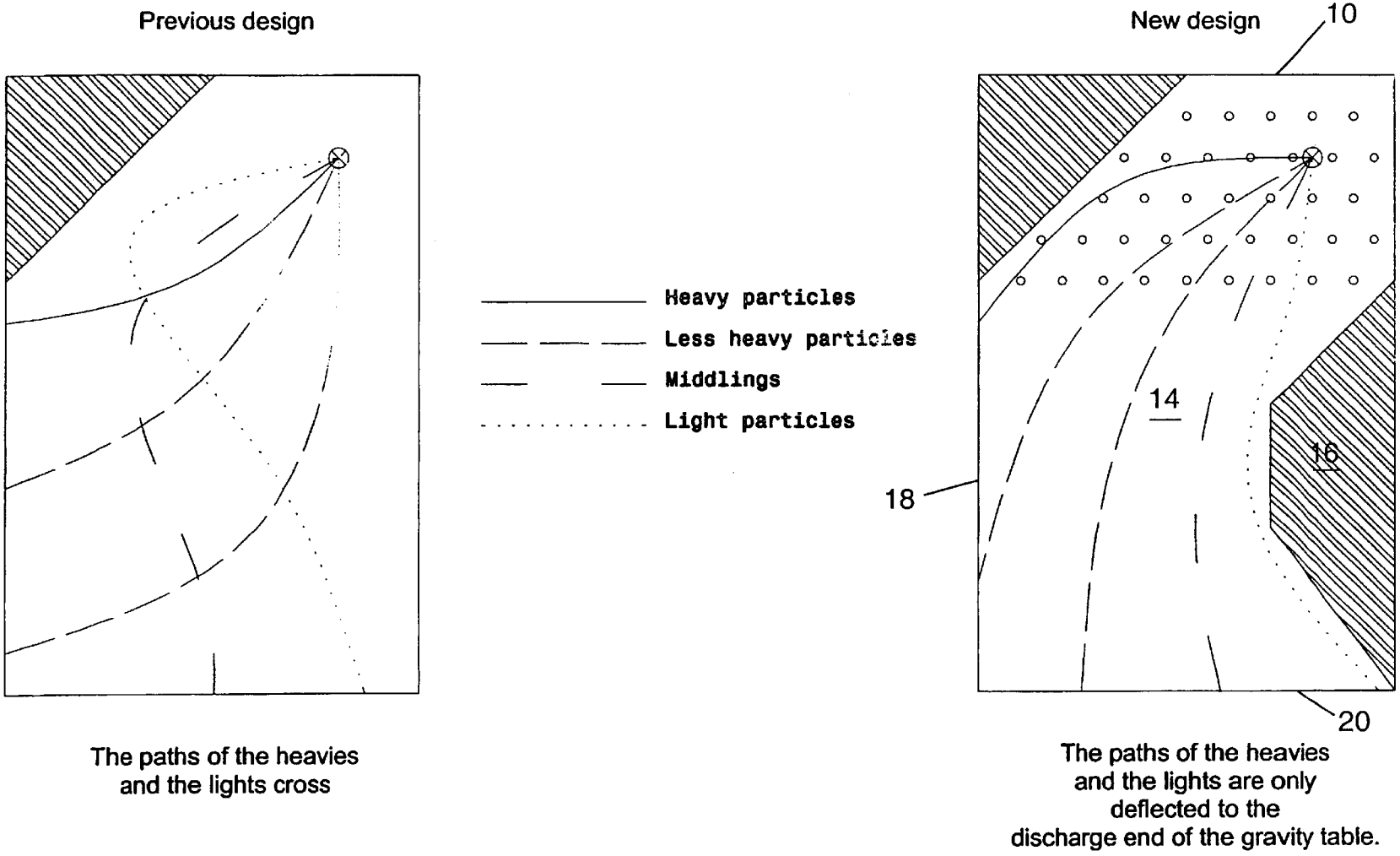
FIG. 2 shows the flow patterns of the weight fractions with the protruding wall and pins on the deck.

In addition to the addition of the pins, the deck shape has been reconfigured in the present invention by bringing a side wall of the deck toward the middle of the table creating a "flow channeler" 16, or "maximizer" (see FIGS. 2, 3). This change in deck shape "guides" the product in a channel. The channel is limited by the regular side wall on one side and the flow channeler on the other. The product coming from the feed area is distributed over the deck in the guided channel as opposed to the full deck. The channel also keeps the thickness of the product layer relatively constant in this area (approximately the first quarter, until the first heavies drop over the heavy side edge), thereby further increasing the efficiency of the stratification. In the area between the heavy side edge and the next half of the length of the deck, the discharge of the heavies is controlled by the adjustable flaps assisted by the flow channeler. The last quarter of the deck is then used for separating the middlings and lights, since most of the heavies have dropped before this. The area for separation, as a result of the removal of heavies and the channeler shape, increases in this last quarter and the layer of product is controlled by the flaps on the lights discharge edge with the channeler. This ultimately creates non-crossing, or roughly parallel, flow of the weight fractions toward their respective discharge points. Without this change in flow pattern, the heavies and lights must compete against each other as they flow in opposite directions and cross paths (crossing flow) across the table (See FIG. 2). Not only does the side wall reconfiguration change the flow pattern of the product, but the light fraction has a shorter distance to travel. The lights move toward the "light rail" (the side wall where the flow channeler is found) and tend to stay on the light rail once there. This results in a sharper and smaller zone of middlings. This reduces the amount of good product and the light fraction in the middlings without increasing the size of middlings fraction which must be rerun on the separator.

The preferred flow channeler is designed to channel the product in about the first quarter of the length of the deck, assist in discharge of heavies in approximately the next half of the deck, and support the separation of the product in about the last quarter of the deck in addition to increasing the length of the light rail side wall. The design and placement of the flow channeler is optimized to each deck size, the length of the discharge edges, and the nominal capacity of the gravity table. The material of construction of the channeler is non-critical. The placement of the flow channeler is such that the desired flow is achieved, that is essentially eliminating the crossing of the flow paths of the weight fractions. The placement is on the "light rail" of the deck. The flow channeler that has been used was constructed of aluminum and was placed as indicated in the Figures. The constructed flow channeler was welded into shape and fixed onto the wire-mesh and the light rail side wall by bolting. Alternative materials include, but are not limited to, galvanized steel, stainless steel, painted mild steel, depending on the material of the wire-mesh of the deck. Even with the reduction in deck size due to the addition of the flow channeler (in the constructed devices this was a 20% reduction) the overall capacity of the machine was kept the same while improving separation. The size, shape, material, and placement of the flow channeler is readily determined by one of ordinary skill in the art for a particular application.

The present invention reduces the size of the discarded weight fractions while maintaining high throughput. The overall separation efficiency is greatly increased. Test runs of the invention with soybeans have achieved a greater than 50% reduction in the amount of heavy product in the light fraction and a reduction in middlings of greater than 25%. The benefit of this design lowers equipment and operating costs per capacity, gives more capacity per square foot of floor space, lowers the good seed loss, results in smaller rerun middling stream, and therefore, give a much higher return on investment.

EXAMPLES

The design change of the present invention was tested against standard gravity table equipment to determine the increased separation efficiency.

Example 1

Results Using Cimbria Heid Model GA300

The Cimbria Heid Model GA300 has the following dimensions and specifications:

TABLE 1

Gravity table specifications.

| Specifications | | GA 300 |
|---|---|---|
| Capacity | t/h | |
| Corn, wheat, soybeans | | 15 |
| Fan Drive | kw | 15 |
| Reciprocating drive | kw | 1.1 |
| Table area | $m^2$ | 5.5 |
| Air requirement | $m^3$/min | 720 |
| Dimensions | cm | |
| Length | | 384 |
| Width | | 211 |
| Height | | 171 |

TABLE 2

Test run.

| | | |
|---|---|---|
| Product: | Soybeans | |
| | weight/100 l | 74.8 kg/hl |
| | brokens | 1.8% |

TABLE 3

Setup discharging:

| | |
|---|---|
| Heavies | 76.8% |
| Middlings | 20.0% |
| Lights | 3.2% |

TABLE 4

Results.

| | Capacity t/h | Heavies Brokens % | Heavies kg/hl | Heavies 1000 kernels g | Heavies throughs <Ø6 mm % | Middlings brokens % | Middlings kg/hl | Middlings 1000 kernels g | Middlings throughs <Ø6 mm % | Lights brokens % | Lights kg/hl | Lights 1000 kernels g | Lights throughs <Ø6 mm % |
|---|---|---|---|---|---|---|---|---|---|---|---|---|---|
| with pins & maximizer | 12 | 0.26 | 75.2 | 152 | 7.9 | 3.0 | 74.6 | 137 | 20.3 | 17.9 | 70.0 | 127 | 24.7 |
| no pins or maximizer | 12 | 0.64 | 75.2 | 151 | 11.2 | 4.1 | 74.6 | 142 | 24.9 | 12.3 | 70.0 | 135 | 22.0 |

Example 2

Results Using Cimbria Heid Model GA200

The Cimbria Heid Model GA200 has the following dimensions and specifications:

TABLE 7

| Set-up discharging: | |
|---|---|
| Heavies | 78.0% |
| Middlings | 20.0% |
| Lights | 2.0% |

TABLE 8

Results.

| | Capacity t/h | Heavies Brokens % | Heavies kg/hl | Heavies 1000 kernels g | Heavies throughs <Ø6 mm % | Middlings brokens % | Middlings kg/hl | Middlings 1000 kernels g | Middlings throughs <Ø6 mm % | Lights brokens % | Lights kg/hl | Lights 1000 kernels g | Lights throughs <Ø6 mm |
|---|---|---|---|---|---|---|---|---|---|---|---|---|---|
| with pins & maximizer | 8 | 0.22 | 75.4 | 157 | 5.6 | 4.9 | 74.3 | 139 | 17.4 | 23.4 | 67.0 | 129 | 26.2 |
| no pins or maximizer | 8 | 0.63 | 75.2 | 156 | 7.6 | 4.2 | 74.4 | 143 | 14.7 | 25.8 | 70.0 | 134 | 21.0 |

TABLE 5

Gravity table specifications.

| Specifications | | GA 200 |
|---|---|---|
| Capacity | t/h | |
| Corn, wheat, soybeans | | 10 |
| Fan Drive | kw | 11 |
| Reciprocating drive | kw | 1.1 |
| Table area | $m^2$ | 3.6 |
| Air requirement | $m^3$/min | 500 |
| Dimensions | cm | |
| Length | | 330 |
| Width | | 185 |
| Height | | 144 |

TABLE 6

Test run.

| | | |
|---|---|---|
| Product: | Soybeans | |
| | weight/100 l | 74.8 kg/hl |
| | brokens | 1.8% |

Having described the invention with reference to particular compositions, theories of effectiveness, and the like, it will be apparent to those of skill in the art that it is not intended that the invention be limited by such illustrative embodiments or mechanisms, and that modifications can be made without departing from the scope or spirit of the invention, as defined by the appended claims. It is intended that all such obvious modifications and variations be included within the scope of the present invention as defined in the appended claims. The claims are meant to cover the claimed components and steps in any sequence which is effective to meet the objectives there intended, unless the context specifically indicates to the contrary.

What is claimed is:

1. A gravity separator comprising:

a movable and tiltable deck, wherein the deck comprises pins perpendicular to the deck which create space in a bed of material desired to be separated, and a flow channeler which lengthens a side wall of the deck and directs flow of the material such that flow paths of weight fractions of the material are essentially parallel; and a pressure device wherein the pressure device creates a pressure differential for creating space in the bed of material.

2. The separator of claim 1 wherein the pressure device is a blower.

3. The separator of claim 1 wherein the flow channeler is a protrusion of the light rail side wall of the deck.

4. The separator of claim 3 wherein the flow channeler reduces the deck area by about 20%.

5. The separator of claim 3 wherein the flow channeler channels the material in approximately the first quarter of the deck, assists in heavy fraction discharge in approximately the next half of the deck, and aids separation of the weight fractions in approximately the last quarter of the deck.

6. The separator of claim 1 wherein the pins are located in the feed area of the deck.

7. The separator of claim 1 wherein the pins are generally cylindrical with top portions that angle outward from the cylindrical portion.

8. The separator of claim 1 wherein the pins aid stratification of the weight fractions of the material.

9. The separator of claim 1 wherein the amount of the heavy fraction of the material in the light fraction of the material is reduced by about greater than or equal to 50% compared to the amount of the heavy fraction of the material in the light fraction of the material from the same gravity separator with no pins or flow channeler.

10. The separator of claim 1 wherein the amount of middlings fraction is reduced by about greater than or equal to 25% compared to the amount of middlings fraction from the same gravity separator with no pins or flow channeler.

11. A gravity separator comprising a deck comprising pins perpendicular to the deck which create space in a bed of material desired to be separated, and a flow channeler which lengthens a side wall of the deck and directs flow of the material such that the flow paths of the weight fractions of the material do not cross;

means for creating a pressure differential through the bed of material;

means for vibrating the deck; and means for tilting the deck.

12. A gravity table separator wherein the improvement comprises pins perpendicular to a deck of the gravity table which create space in a bed of material desired to be separated and a flow channeler which lengthens the light rail side wall of the gravity table and directs flow the weight fractions of the material such that the flow paths of the fractions are essentially parallel.

13. A method for gravimetrically separating a product of similar size comprising vibrating a bed of the product, stratifying weight fractions of the product, tilting the bed of product, creating space in a bed of the product desired to be separated wherein the space is substantially perpendicular to the bed, and creating flow paths of the weight fractions of the material which are substantially parallel to each other.

* * * * *